US011970811B2

(12) United States Patent
de Freitas Goncalves et al.

(10) Patent No.: US 11,970,811 B2
(45) Date of Patent: Apr. 30, 2024

(54) OVERMOLDED BASKET BASE ASSEMBLY

(71) Applicant: WHIRLPOOL CORPORATION, Benton Harbor, MI (US)

(72) Inventors: Jesse de Freitas Goncalves, St. Joseph, MI (US); Kenneth McConnell, Stevensville, MI (US); Steven Fricke, St. Joseph, MI (US); Marcos H. Herrmann, Stevensville, MI (US); Bradley D. Morrow, Stevensville, MI (US); Eric J. Walsh, St. Joseph, MI (US); Christine L. Strain, Benton Harbor, MI (US); Peter A. Wagoner, Benton Harbor, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 193 days.

(21) Appl. No.: 17/342,433

(22) Filed: Jun. 8, 2021

(65) Prior Publication Data

US 2022/0389636 A1 Dec. 8, 2022

(51) Int. Cl.
*D06F 37/24* (2006.01)
*D06F 37/12* (2006.01)

(52) U.S. Cl.
CPC ..... *D06F 37/24* (2013.01); *D06F 37/12* (2013.01)

(58) Field of Classification Search
CPC ..... D06F 37/12; D06F 37/24
See application file for complete search history.

(56) References Cited

U.S. PATENT DOCUMENTS

| | | | | |
|---|---|---|---|---|
| 10,218,233 | B2 * | 2/2019 | Bhargava | H02K 21/12 |
| 10,326,323 | B2 | 6/2019 | Bhargava et al. | |
| 2005/0138971 | A1 | 6/2005 | Ozturk et al. | |
| 2013/0104385 | A1 * | 5/2013 | Dokonal | H02K 1/2791 29/598 |
| 2013/0312462 | A1 * | 11/2013 | Kim | D06F 21/08 68/133 |
| 2018/0080161 | A1 * | 3/2018 | Fricke | D06F 37/304 |

FOREIGN PATENT DOCUMENTS

| | | | |
|---|---|---|---|
| DE | 102010017350 | B3 | 10/2011 |
| JP | 2014061049 | A | 4/2014 |
| WO | 2017029416 | A1 | 2/2017 |
| WO | 2019017799 | A1 | 1/2019 |

* cited by examiner

*Primary Examiner* — Cristi J Tate-Sims
(74) *Attorney, Agent, or Firm* — Brooks Kushman P.C.

(57) ABSTRACT

A hub for an overmolded basket base assembly of a laundry appliance is provided. The hub includes a central core defining an opening along an axis configured to receive a drive shaft. The hub further includes a disc, extending radially outwardly from the core about the axis, the disc configured to be overmolded in polymeric material that forms an overmolded plastic base, the disc including a plurality of posts arranged around the core and extending upward from a top surface of the disc to form a circumferentially-extending array to align the hub when applying torque to the hub.

19 Claims, 6 Drawing Sheets

OVERMOLDED BASKET BASE ASSEMBLY

TECHNICAL FIELD

Aspects of the disclosure relate to a basket base for a laundry appliance having a metallic hub and an overmolded plastic base.

BACKGROUND

Laundry treating appliances may include a perforated basket or drum for holding a laundry load and a tub holding the basket to contain the wash liquid. A laundry mover may be rotationally mounted in the bottom of the basket and adapted for angular oscillation in order to agitate the laundry load. In one configuration, the basket, the laundry mover, and the tub may be oriented about a vertical axis. The basket may be supported by a basket base assembly.

The basket base assembly may be produced via an overmolding process. Overmolding is a process by which a substrate material is at least partially covered by a second material to create a part. Overbuilding may be performed to gain the advantages of multiple types of materials. For instance, it may be advantageous for a part to have the rigidity of the substrate material but the lower weight of the second material.

SUMMARY

In one or more illustrative examples, a hub for an overmolded basket base assembly of a laundry appliance is provided. The hub includes a central core defining an opening along an axis configured to receive a drive shaft. The hub further includes a disc, extending radially outwardly from the core about the axis, the disc configured to be overmolded in polymeric material that forms an overmolded plastic base, the disc including a plurality of posts arranged around the core and extending upward from a top surface of the disc to form a circumferentially-extending array to align the hub when applying torque to the hub.

In one or more illustrative examples, an overmolded basket base assembly of a laundry appliance is provided. An overmolded plastic base is composed of polymeric material. A hub includes a central core defining an opening along an axis configured to receive a drive shaft. The hub further includes a disc, extending radially outwardly from the core about the axis, the disc configured to be overmolded in the polymeric material that forms the overmolded plastic base, the disc including a plurality of posts arranged around the core and extending upward from a top surface of the disc to form a circumferentially-extending array to align the hub when applying torque to the hub.

DETAILED DESCRIPTION

Figure 1:
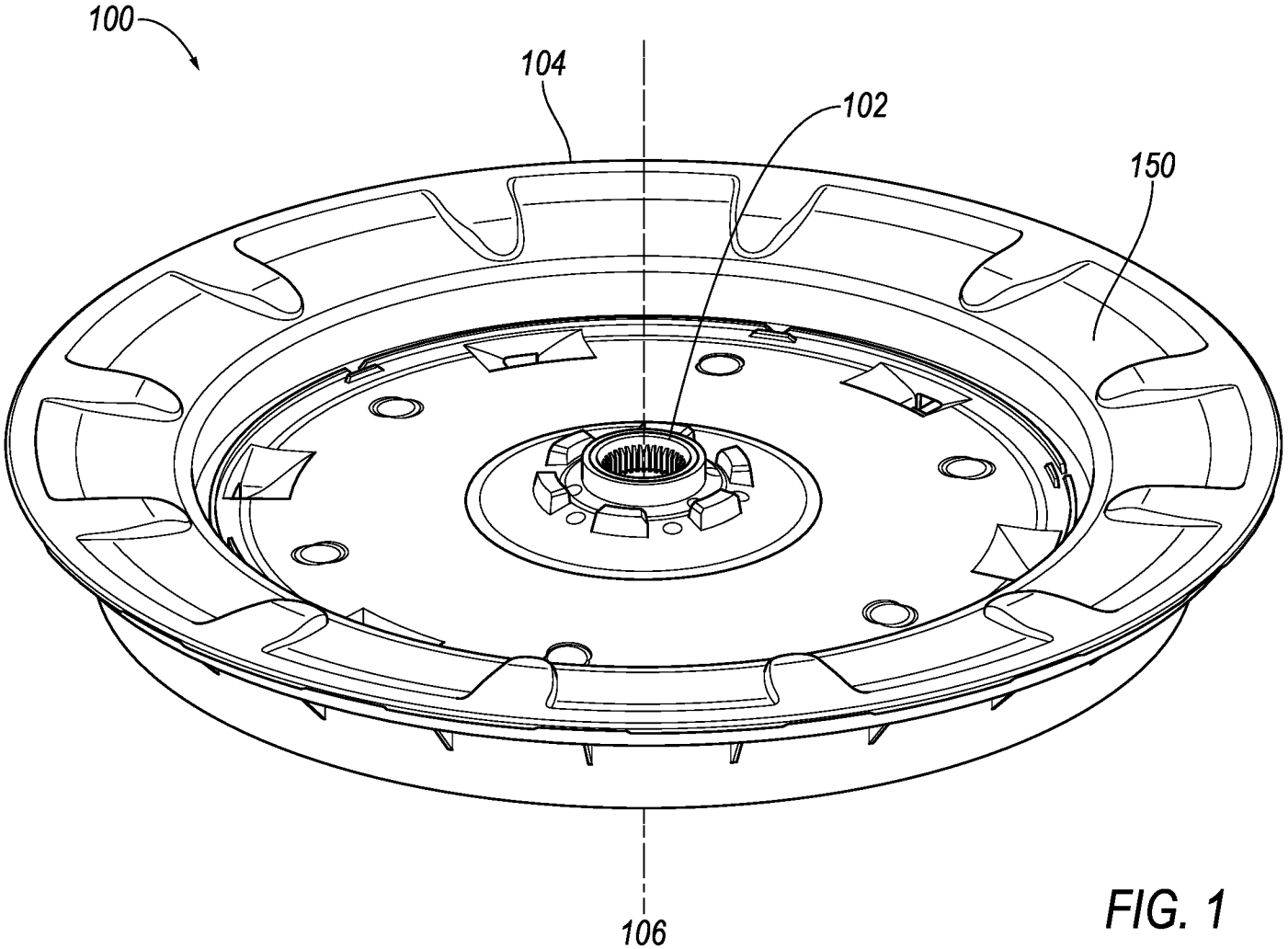
FIG. 1 is a top perspective view of a basket base for a laundry appliance.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Moreover, except where otherwise expressly indicated, all numerical quantities in this disclosure are to be understood as modified by the word "about" in describing the broader scope of this disclosure. Practice within the numerical limits stated is generally preferred. Also, unless expressly stated to the contrary, the description of a group or class of materials by suitable or preferred for a given purpose in connection with the disclosure implies that mixtures of any two or more members of the group or class may be equally suitable or preferred.

A basket base may be used to support a laundry drum in a laundry treatment appliance. The basket base may have an overmolded hub. The hub may be a metallic material, such as aluminum, aluminum alloy, or another formable metallic material. As opposed to a typical center hub insert, the hub includes an outwardly extending disc having various features to improve hub characteristics. The hub disc includes posts that interface with the die casting guns in the production line, to keep the base in place when applying torque to assemble the base. The hub disc also includes a groove about the circumference of the top surface of the hub to improve the bonding condition after injection so the plastic will shrink into the hub. The hub disc also includes apertures to further aid in the interface between the metallic and the polymeric material, as the polymeric material will flow through the apertures during overmolding to keep a constant thickness and prevent voids and other injection issues. The hub disc also includes a vertical wall extending around the circumference of the hub, both to improve the interfacing of the hub with the polymeric material and also to provide greater robustness against deflections. Accordingly, this design improves cost by delivering an overmolded hub with a better interface between the polymeric material and substrate and better performance.

Figure 2:
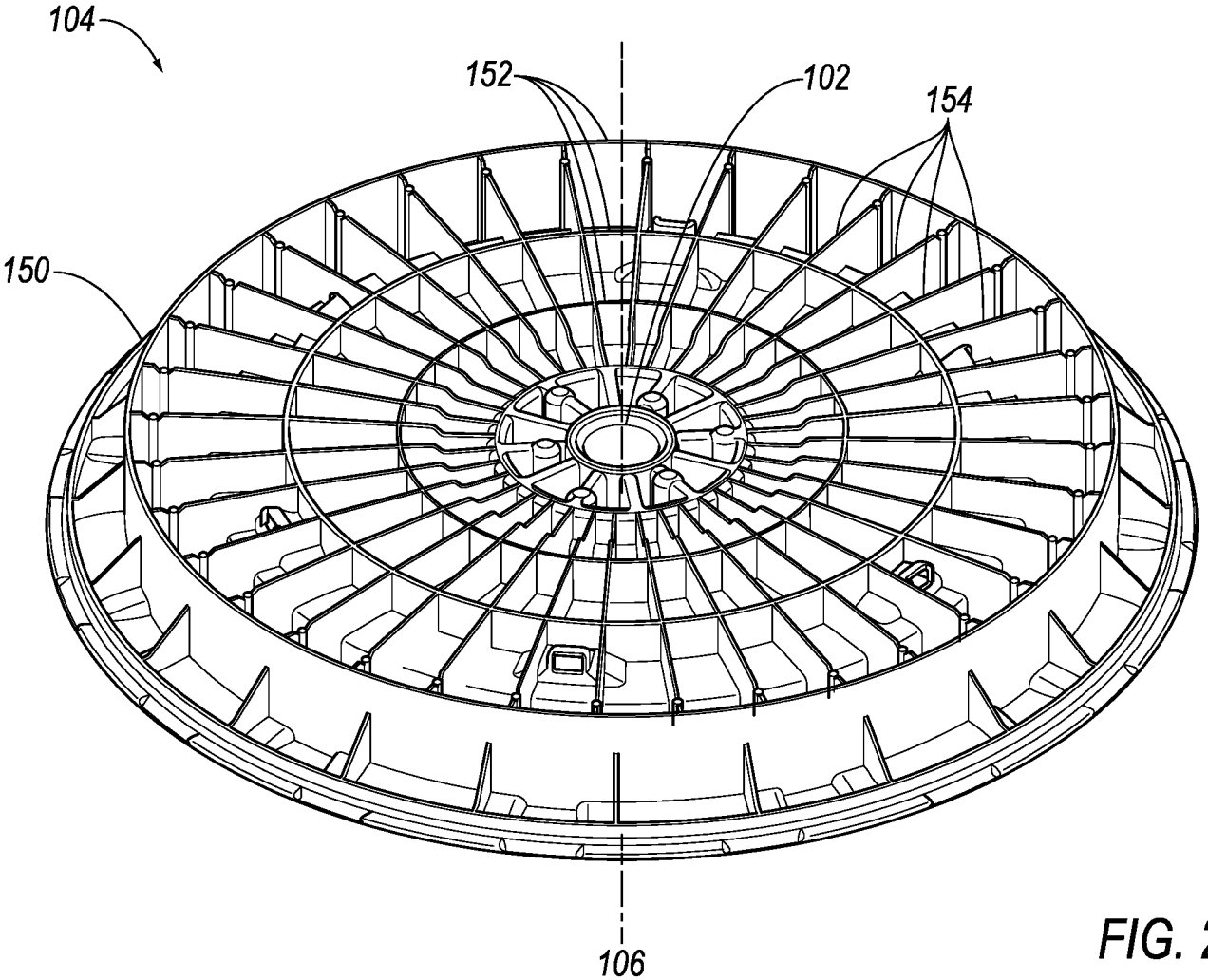
FIG. 2 is a bottom perspective view of the basket base for the laundry appliance.

FIG. 1 is a top perspective view of a basket base assembly 100 for a laundry appliance. FIG. 2 is a bottom perspective view of the basket base assembly 100 for the laundry appliance. Referring collectively to FIGS. 1 and 2, the basket base assembly 100 includes a hub 102 and an overmolded plastic base 104. The basket base assembly 100 may be configured to be mounted in a laundry appliance (not shown) via the hub 102 to revolve about a vertical axis 106.

Figure 3:
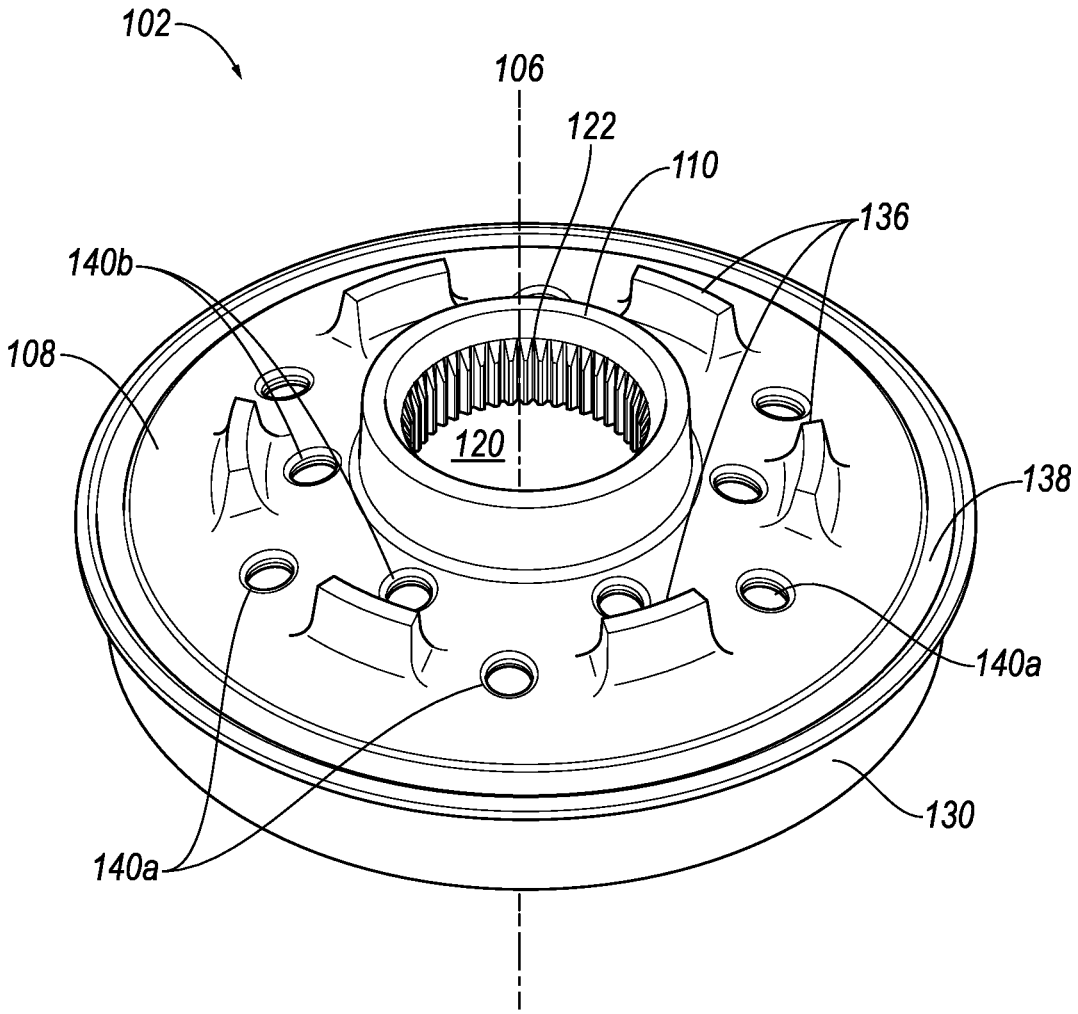
FIG. 3 is a top perspective view of a hub of the basket base.
Figure 4:
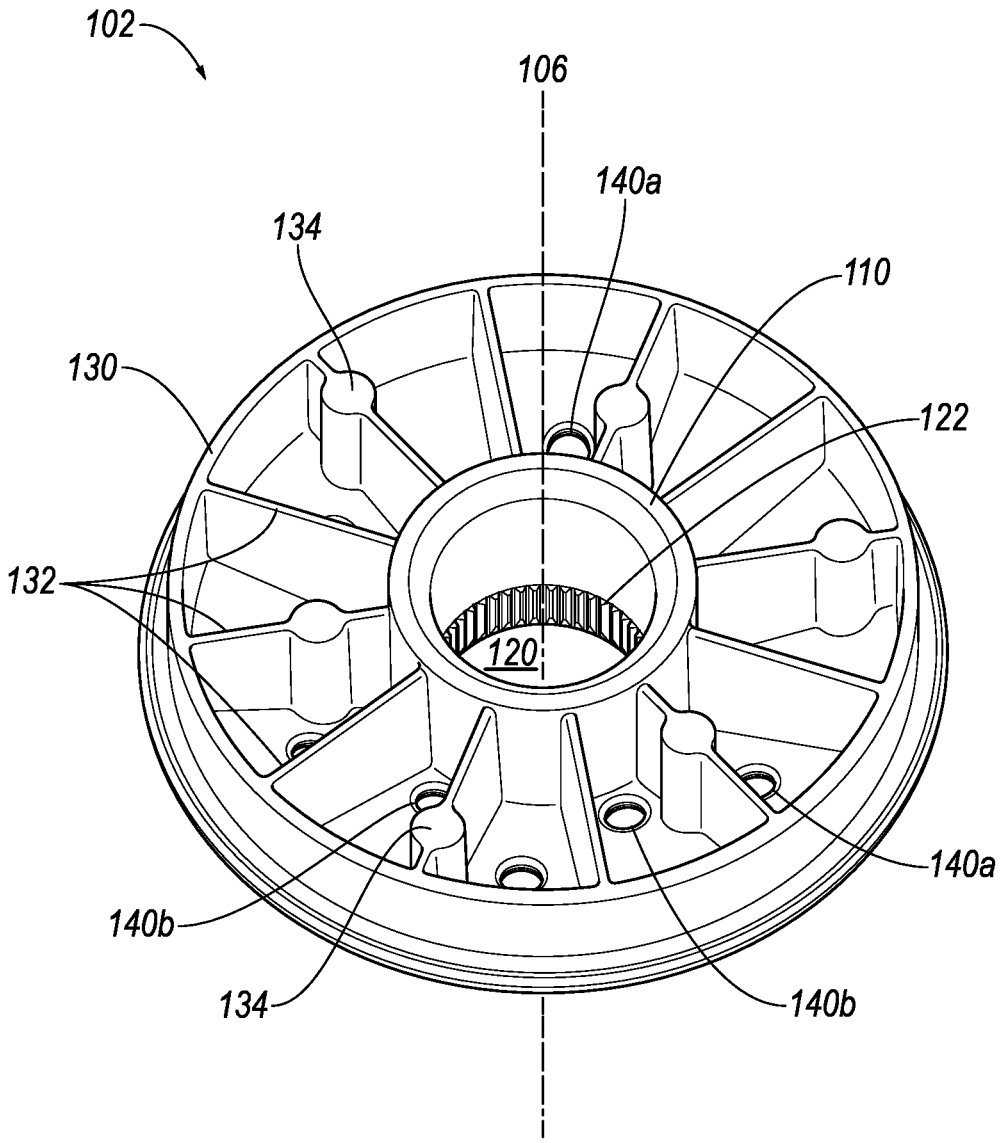
FIG. 4 is a bottom perspective view of the hub of the basket base.

FIG. 3 is a top perspective view of the hub 102 of the basket base assembly 100, which FIG. 4 is a bottom perspective view of the hub 102 of the basket base assembly 100. The hub 102 may be formed of a metallic material, such as aluminum, aluminum alloy, or another formable metallic material, and may be suitable for overmolding into the polymeric material of the overmolded plastic base 104.

Figure 5:
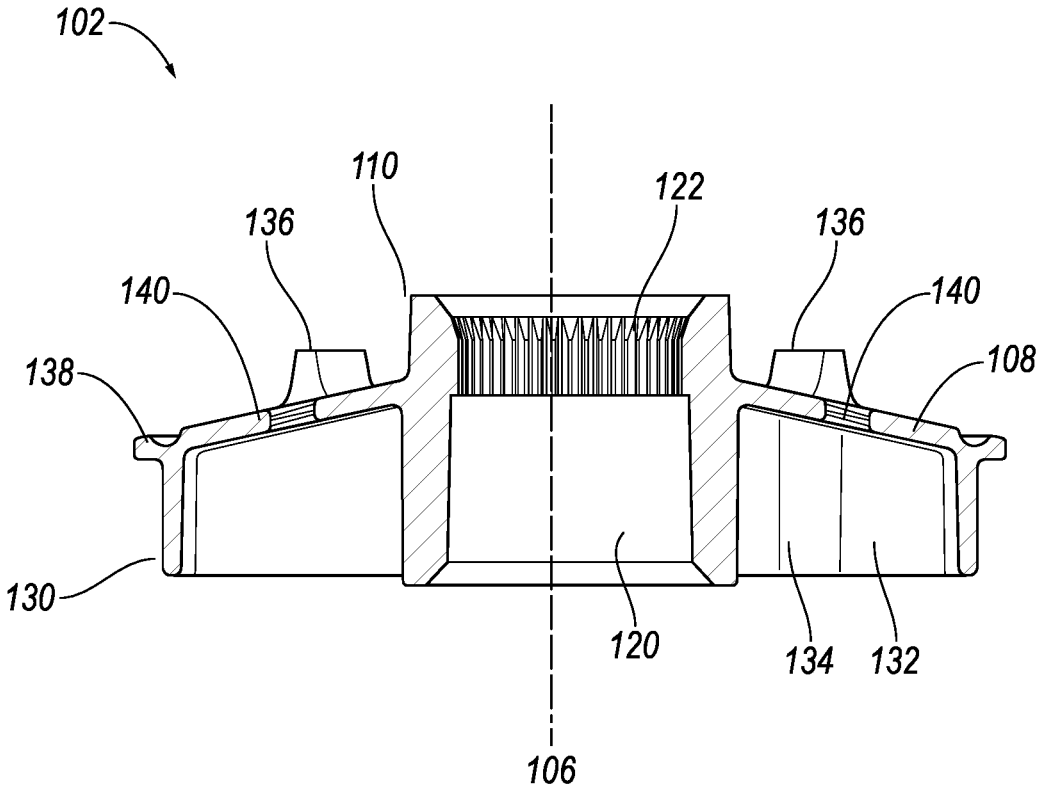
FIG. 5 is a second view of the hub.

The hub 102 generally includes a hub disc 108 circumferentially extending outward from a cylindrical core 110 onto which the plastic base 104 may be overmolded. As best seen in FIG. 5, the hub disc 108 may extend at an acute angle downward from the cylindrical core 110. As discussed in detail herein, the hub disc 108 includes various features to improve hub 102 characteristics with respect to its integration into the overmolded plastic base 104 of the basket base assembly 100.

The cylindrical core 110 may extend along the vertical axis 106 for the height of the basket base assembly 100. The cylindrical core 110 may define an axially-extending through opening 120 for engagement with a drive shaft (not shown). The axially-extending opening 120 may have a plurality of grooves or interior teeth 122 along at least a portion of the depth of the opening 120 to provide for engagement with corresponding teeth of the drive shaft. This may allow the hub 102 to facilitate the transfer of torque about the vertical axis 106 from the drive shaft to the basket base assembly 100.

The hub disc 108 may extend outward from the cylindrical core 110 a distance from the top of the cylindrical core 110. In an example this distance may be consistent with the distance that the teeth 122 extend into the opening 120, approximately one third of the overall height of the hub 102.

The hub disc 108 may further define a vertical wall 130 extending downward from the bottom face of the hub disc 108 about the circumference of the hub 102. In an example, the vertical wall 130 may extend downward to approximately the same lower extent as the lower extent of the cylindrical core 110. Once overmolded, the vertical wall 130 may improve the interfacing of the hub 102 with the polymeric material and provide greater robustness of the overall basket base assembly 100 against deflections.

The hub 102 may also define radial reinforcing ribs 132 to further increase the strength of the hub 102. The radial reinforcing ribs 132 may extend downward from the lower surface of the hub disc 108, radially outward from the outer diameter of the cylindrical core 110 to the interior of the vertical wall 130. These radial reinforcing ribs 132 may be provided at equal intervals from one another in many examples. As shown, the hub 102 includes twelve radial reinforcing ribs 132, but hubs 102 having more or fewer radial reinforcing ribs 132 are contemplated. In some instances, to provide for further structural integrity of the hub 102, at least a portion of the radial reinforcing ribs 132 may include support rods 134 extending downward from the lower surface of the hub disc 108. As shown, every other radial reinforcing rib 132 includes a support rod 134, although this is only one example.

The hub disc 108 may include posts 136 extending upward from the top surface of the hub disc 108 to form a circumferentially-extending row or array. In an example, the posts 136 may be placed approximately halfway between the cylindrical core 110 and the circumference of the hub disc 108. The posts 136 may be designed to interface with die casting guns in the production line (not shown). This interfacing may allow for the basket base assembly 100 to better remain in place when applying torque to assemble the basket base assembly 100 to the laundry machine. As shown, the hub 102 includes six posts 136, but hubs 102 having more or fewer posts 136 are contemplated.

The hub disc 108 may also include a groove 138 about the circumference of the top surface of the hub 102. The groove 138 may define a recess into the top surface of the hub disc 108, thereby providing a lip about the circumference of the hub disc 108. This groove 138 may serve to improve the bonding condition after injection basket base assembly 100 the plastic will shrink and lock down into the groove 138 and onto the hub 102.

The hub disc 108 may further include through apertures 140 to aid in the interface between the material of the hub 102 and the material of the overmolded plastic base 104. During the overmolding, flowing polymeric material may traverse the apertures 140 to aid in the maintaining of a constant thickness of the overmolded plastic base 104 and the prevention of voids.

In an example, the radial reinforcing ribs 132 may define open-bottomed chambers between the exterior of the cylindrical core 110, the interior of the vertical wall 130, and the lower surface of the hub disc 108. Accordingly, to provide for the flow of polymeric material during the overmolding process, the apertures 140 are placed in the surface of the hub disc 108 open to each of the chambers. As best seen in FIGS. 3-4, in the illustrated example, a first set of apertures 140*a* are placed between the posts 136 in the circumferentially-extending row or array, and a second set of apertures 140*b* are placed between the posts 136 and the cylindrical core 110.

Turning to the structure of the overmolded plastic base 104, the overmolded plastic base 104 includes a base wall 150 formed as an outwardly extending disc. One or more reinforcing rings 152 may extend concentrically with respect to the vertical axis 106 downward from the base wall 150. In addition, radially extended reinforcing ribs 154 may extend outward from the center of the overmolded plastic base 104, preferably, at equal distances from one another to increase the strength of the overmolded plastic base 104. As such, a stable construction of the overmolded plastic base 104 is provided.

Figure 6:
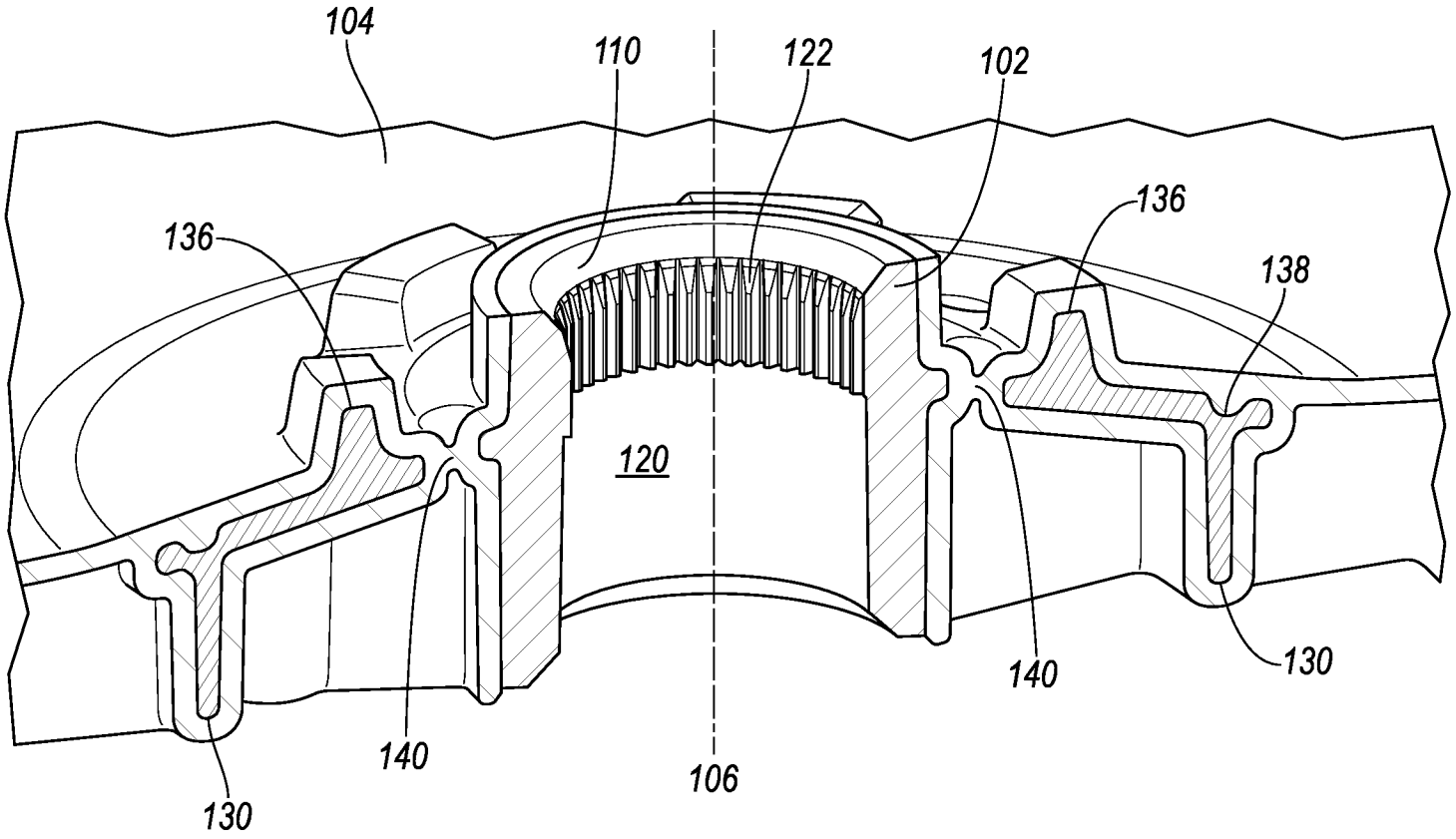
FIG. 6 is a section view of the hub overmolded into the basket base.

FIG. 6 is a section view of the hub 102 overmolded into the overmolded plastic base 104. As shown, the polymeric material has flowed around the posts 136 that interface with the die casting guns in the production line, which will allow the basket base assembly 100 to be maintained in place when applying torque to assemble the basket base assembly 100. The polymeric material has also flowed into the groove 138 about the circumference of the top surface of the hub 102 and shrink down to the hub 102 to improve the bonding. Additionally, the polymeric material that forms the overmolded plastic base 104 has flowed through the apertures 140 without causing voids in the basket base assembly 100. The polymeric material has also flowed around the vertical wall 130 extending around the circumference of the hub 102, both to improve the interfacing of the hub 102 with the polymeric material and also to provide greater robustness against deflections. Accordingly, this design improves cost by delivering a basket base assembly 100 including an overmolded hub 102 with a stronger interface between the polymeric material and substrate and better performance.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated.

While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A hub for an overmolded basket base assembly of a laundry appliance, comprising:

a central core defining an opening along an axis configured to receive torque from a drive shaft; and a disc, extending radially outwardly from the central core about the axis, the disc configured to be overmolded in polymeric material that forms an overmolded plastic base, the disc including a plurality of posts arranged around the central core and extending upward from a top surface of the disc to form an array to align the hub when applying the torque to the hub, the disc further comprising radial reinforcing ribs defining open-bottomed chambers between an exterior of the central core, an interior of a vertical wall extending downward from a bottom face of the disc about its circumference, and the bottom face of the disc, the disc further defining apertures through the top surface of the disc open to the open-bottomed chambers to provide for flow of the polymeric material during overmolding of the polymeric material.

2. The hub of claim 1, wherein the hub is composed of aluminum or aluminum alloy.

3. The hub of claim 1, wherein the plurality of posts are configured to interface with die casting guns in a production line.

4. The hub of claim 1, wherein the disc defines a circumferential groove about an outer diameter of a top surface of the hub to improve a bonding condition of the polymeric material of the overmolded plastic base such that the polymeric material shrinks into the groove of the hub.

5. The hub of claim 1, further comprising interior teeth extending vertically for at least a portion of the depth of an interior of the core to provide engagement with corresponding teeth of the drive shaft.

6. The hub of claim 1, further comprising a vertical wall extending downward from a bottom face of the disc about the circumference of the hub to reduce deflections and to improve interfacing of the hub with the polymeric material of the overmolded plastic base.

7. The hub of claim 6, wherein the vertical wall extends downward to a same lower extent as that of the core.

8. The hub of claim 7, further comprising radial reinforcing ribs extending downward from an underside of the disc and radially outward from the exterior of the core to the interior of the vertical wall to increase strength of the hub.

9. The hub of claim 8, wherein the radial reinforcing ribs are provided at equal intervals from one another.

10. The hub of claim 8, wherein at least a subset of the radial reinforcing ribs include support rods extending downward from a lower surface of the disc.

11. The hub of claim 1, wherein the apertures include a first set of apertures between the posts, and a second set of apertures between the posts and the central core.

12. An overmolded basket base assembly of a laundry appliance, comprising:

an overmolded plastic base composed of polymeric material; and a hub, comprising:

a central core defining an opening along an axis configured to receive a drive shaft, and a disc, extending radially outwardly from the core about the axis, the disc configured to be overmolded in the polymeric material that forms the overmolded plastic base, the disc including a plurality of posts arranged around the core and extending upward from a top surface of the disc to form a circumferentially-extending array to align the hub when applying torque to the hub, the disc further comprising radial reinforcing ribs defining open-bottomed chambers between an exterior of the central core, an interior of a vertical wall extending downward from a bottom face of the disc about its circumference, and the bottom face of the disc, the disc further defining apertures through the top surface of the disc open to the open-bottomed chambers to provide for flow of the polymeric material during overmolding of the polymeric material.

13. The overmolded basket base assembly of claim 12, wherein the hub is composed of aluminum or aluminum alloy.

14. The overmolded basket base assembly of claim 12, wherein the plurality of posts are configured to interface with die casting guns in a production line.

15. The overmolded basket base assembly of claim 12, wherein the disc defines a circumferential groove about an outer diameter of a top surface of the hub to improve a bonding condition of the polymeric material of the overmolded plastic base such that the polymeric material shrinks into the groove of the hub.

16. The overmolded basket base assembly of claim 12, further comprising interior teeth extending vertically for at least a portion of the depth of an interior of the core to provide engagement with corresponding teeth of the drive shaft.

17. The overmolded basket base assembly of claim 12, wherein the vertical wall extends downward to a same lower extent as that of the core.

18. The overmolded basket base assembly of claim 17, wherein the radial reinforcing ribs are provided at equal intervals from one another and at least a subset of the radial reinforcing ribs include support rods extending downward from a lower surface of the disc.

19. A hub for an overmolded basket base assembly of a laundry appliance, comprising:

a central core defining an opening along an axis configured to receive torque from a drive shaft; and a disc, extending radially outwardly from the central core about the axis, the disc configured to be overmolded in polymeric material that forms an overmolded plastic base, the disc including a plurality of posts arranged around the central core and extending upward from a top surface of the disc to form an array to align the hub when applying the torque to the hub, the plurality of posts configured to interface with die casting guns in a production line, the disc further defining apertures arranged circumferentially about the central core, through which the polymeric material of the overmolded plastic base flows during overmolding of the polymeric material, wherein the apertures include a first set of apertures between each of the posts and a second set of apertures are placed between the posts and the central core, the disc further comprising a vertical wall extending downward from a bottom face of the disc about its circumference and radial reinforcing ribs extending downward from the bottom face of the disc and radially outward from the exterior of the core to the interior of the vertical wall to increase strength of the hub, the radial reinforcing ribs defining open-bottomed chambers between the exterior of the central core, the interior of the vertical wall, and the bottom face of the disc, each of the apertures being defined in the surface of the disc open to a respective one of the open-bottomed chambers to provide for flow of the polymeric material during the overmolding.

* * * * *